United States Patent [19]

Fricker

[11] Patent Number: 4,702,045

[45] Date of Patent: Oct. 27, 1987

[54] ANCHOR FOR CONCRETING INTO HEAVY LOADS

[76] Inventor: Siegfried Fricker, Wurmberger Strasse, 30-34, 7135 Wiernsheim, Fed. Rep. of Germany

[21] Appl. No.: 889,836

[22] Filed: Jul. 28, 1986

[30] Foreign Application Priority Data

Jul. 27, 1985 [DE] Fed. Rep. of Germany ..... 3526940

[51] Int. Cl.[4] ..... E04G 21/14

[52] U.S. Cl. ..... 52/125.4; 52/698

[58] Field of Search ..... 52/124.2, 125.4, 715, 52/698, 156, 166; 248/224.3, 224.4, 916; 403/274

[56] References Cited

U.S. PATENT DOCUMENTS

| | | | |
|---|---|---|---|
| 1,562,396 | 11/1925 | Ward | 403/274 |
| 1,617,557 | 2/1927 | Weatherhead | 403/274 |
| 2,886,370 | 5/1959 | Liebert | 52/125.4 |
| 3,078,621 | 2/1963 | Hinds | 52/125.4 |
| 4,538,850 | 9/1985 | De Vito | 52/125.2 |
| 4,571,911 | 2/1986 | Danlap | 52/715 |
| 4,580,378 | 4/1986 | Kelly | 52/125 |

FOREIGN PATENT DOCUMENTS

| | | | |
|---|---|---|---|
| 2232374 | 1/1974 | Fed. Rep. of Germany | 52/125.5 |

*Primary Examiner*—Henry E. Raduazo

*Attorney, Agent, or Firm*—Schwartz, Jeffery, Schwaab, Mack, Blumenthal & Evans

[57] ABSTRACT

An anchor of solid material is adapted to be embedded in a heavy load, for example, a precast concrete member, for permitting lifting of such member. The anchor is comprised of a head formed with a recess for receiving lifting apparatus, and a solid anchor shank terminating at its lower end in a foot adapted to be embedded in such precast member. A separately formed insert extends through an opening formed in the anchor shank, and is positively secured in the opening. The insert has expanding extensions which project laterally from the shank, with the extensions having flat saddle surfaces on the top thereof for better absorption of load forces applied to the anchor. In another embodiment, the separate insert part is positioned around the shank of the anchor and protrudes from all sides. The shank is formed with recesses, and the insert is deformed to be engaged in the recesses and to provide inclined saddle surface at the top of the insert.

16 Claims, 10 Drawing Figures

ANCHOR FOR CONCRETING INTO HEAVY LOADS

BACKGROUND OF THE INVENTION

The invention relates to an anchor consisting of solid material for concreting or embedment in heavy loads, such as precast concrete members.

For the transportation of heavy loads, such as in precast concrete members, prefabricated multi-layer slabs, unitized units, facade linings, supports, spandrel units etc., it is known to embed anchors of steel or iron in the precast concrete member, in such a way that the head of the anchor protrudes from the surface of the concrete member for the engagement of a coupling part of the hoisting tackle. At the same time, the head of the anchor is usually embedded in the precast concrete member in such a way that it lies in a depression provided in the precast concrete member, so that the anchor head does not project beyond the surface of the concrete member. Transport anchors of this type are fabricated from round or flat steel or iron and have an upset round head and foot for load absorption. Anchors of flat steel have on the projecting head part a recess, namely a hole for the coupling of the hoisting tackle. In a known, customary design, the foot part embedded in the concrete is provided with an expansion element for introduction of the load into the concrete, which expansion element is formed by slitting the flat material in the foot part and by bending apart in opposite directions the expanding legs produced by the slitting. The production of this well known anchor is, however, in each case cross-sectionally dependent on the magnitude of the moment of resistance occurring because, depending on stressing, there must always be an adequate cross-section of the anchor to avoid a bending back of the expanding legs under the effect of the load and thus a tearing out of the concreted anchor. It is therefor necessary when dimensioning such an anchor provided with an expanding foot to maintain a minimum cross-section specified for the load envisaged in a particular case, in particular a minimum thickness, to counter the risk of the anchor tearing out.

Round anchors with widened feet and flat anchors with bent-off expanding feet must, in addition, be embedded in the precast concrete member to a load-dependent minimum embedded depth. The greater the load to be absorbed, the deeper the foot of the anchor must be anchored in the concrete member. In addition, an adequate depth of the foot provided with expanding extensions must be maintained during concreting in order to create as great a saddle bearing load as possible and thus a correspondingly large breakout cone in the concrete of the precast member. Furthermore, expanding anchors require a larger design length from the outset as the expansion of the foot caused by separation of the flat material impairs its strength, especially as the incision must be relatively deep to avoid an excessive deformation of the expanding legs during bending.

With thin precast concrete members it is a further disadvantage, for reasons of strength, that both in the case of round anchors with round expanding extensions in the foot and in the case of flat steel expanding anchors with expanding legs which are bent off in opposite directions and offset relative to each other, the forces entering the precast concrete member via the anchor are not precisely directed into the concrete when they are introduced.

It is also known to produce anchors of the generic type in cast steel design, reference being made to U.S. Pat. No. 4,437,642. However, production by this method is elaborate and expensive since for each application load a new mold is necessary, and individual design in particular of the expanding extensions corresponding in shape, size and position with respect to the anchor shank in an application case deviating from the standard size is technically difficult and not economically justifiable. In addition, production from cast iron entails the risk of shrinking; any shrinkage cavities are not externally detectable; so that the finish-cast anchor would have to be subjected to special and elaborate material tests owing to the high safety requirement in the transportation of heavy loads.

For thin precast concrete members it is further known to use so-called two-hole anchors of flat steel which are intended to ensure a deeper introduction of the load into a thin precast concrete member. The head part of such two-hole anchors is designed in the same way as with round or flat anchors. In the foot part, on the other hand, there is a round or oval hole, through which a so-called secondary iron is threaded before concreting, which lies transverse to the longitudinal axis of the transport anchor and is intended to introduce the load forces on either side over a relatively long path deep into the precast concrete member.

In order to be able to thread the secondary iron quickly and simply before concreting, the hole in the foot part of the two-hole anchor must have a correspondingly large clearance. In addition, the secondary iron must have an adequate length, namely up to 10 times the actual anchor length, to achieve its secure anchorage. These requirements necessitate a relatively high amount of material and cost expenditure, especially as the separate threading of the secondary irons requires an additional, relatively complex operation.

SUMMARY OF THE INVENTION

The invention provides an anchor for precast concrete members of the first mentioned characterized in that the expanding extensions, independently of the solid anchor shank, can be adapted quickly and calculably in terms of material, size, shape or position to a given load, such as in the embedding conditions on the precast concrete member, without technical elaboration and without deformations of the anchor foot consisting of solid material.

By the design according to the invention, it is possible with technically simple means to adapt to the respective load situation and to arithmetically determine the position and magnitude of the forces to be incorporated in the precast concrete member in such a manner that optimally uniform forces occur. The anchor can thus be designed shorter, therefore saving material in comparison with known anchors, in particular expanding anchors of the same load category. At the same time, the saddle bearing load of the concrete, which acts on the expanding extensions lying transverse to the anchor, can nevertheless be greater than in the case of comparable known anchors. This makes it possible for the saddle bearing surfaces of the anchor to be arranged comparatively deeper in the precast concrete member than in the case of known expanding anchors, in spite of its shorter design length.

Owing to the fact that the expanding extensions with their flat saddle surfaces are parts separate from the anchor and are positively secured in a recess in the anchor foot, the solid material anchor consisting of anchor foot, anchor shank, anchor head and the expanding extensions separate from it can be produced in a simple and cost-saving way principally by means of punching, pressing or deforming of solid material. It is therefore possible for the expanding extensions with their saddle surfaces to be optimally dimensioned and designed in terms of shape, size and inclination to the longitudinal axis of the anchor and corresponding to the stresses occurring. The anchor according to the invention is, furthermore, no longer tied, like known expanding anchors, to a minimum cross-section, in particular to minimum thickness, whereby less material is needed for its production than for the known expanding anchors respectively of the same load category. A still further advantage is that, as separate parts from the actual anchor, the saddle surfaces can be designed in a simple way such that they are precisely symmetrical to the direction of the load force, irrespective of their particular shape. Finally, the risk of the expanding extensions bending back if the anchor is overloaded is avoided.

BRIEF DESCRIPTION OF THE APPLICATION DRAWINGS

The invention is explained in more detail below using exemplary embodiments and with reference to the drawings, in which.

Figure 3:
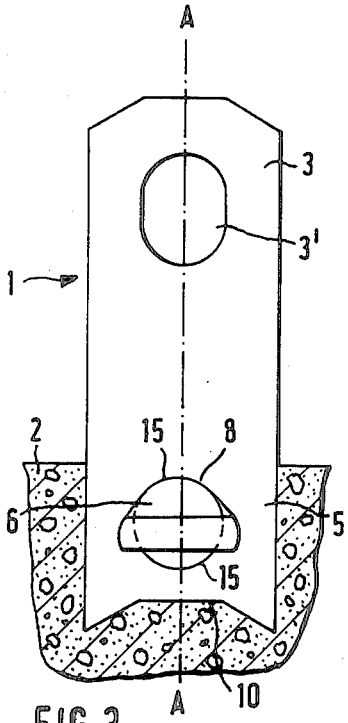
Figure 3A:
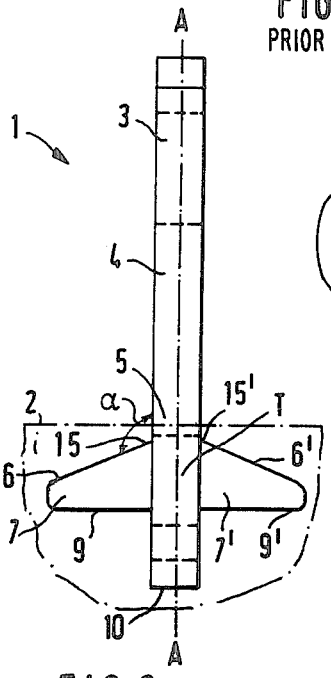
Figure 3B:
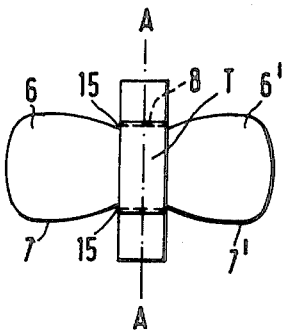
Figure 4:
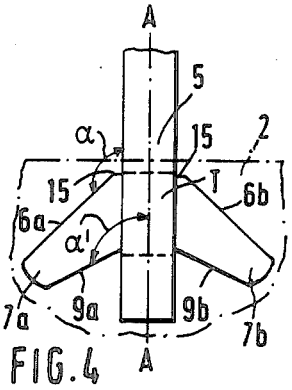
Figure 5:
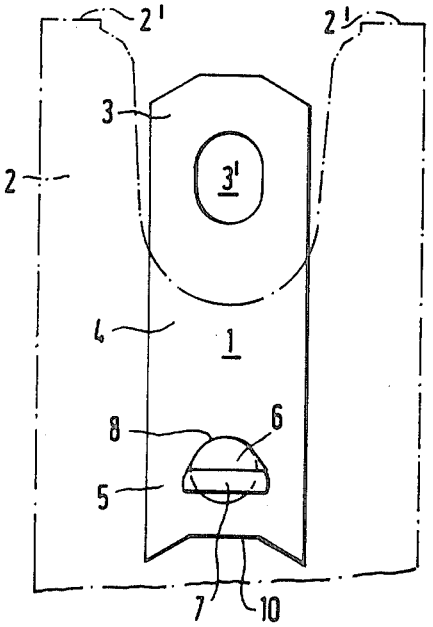
Figure 6:
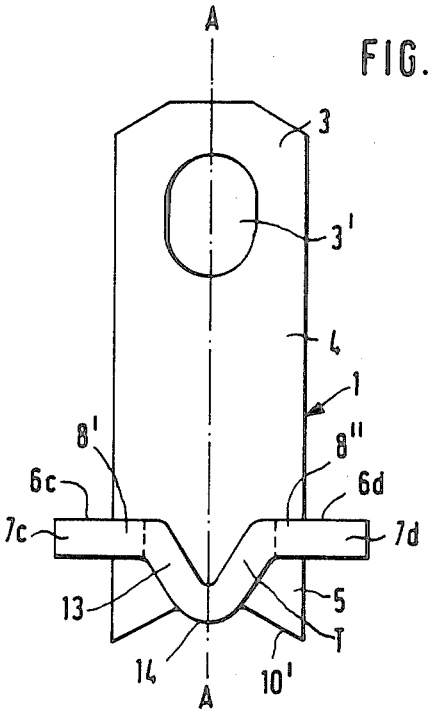
Figure 6A:
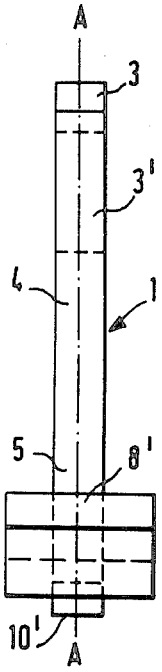
Figure 6B:
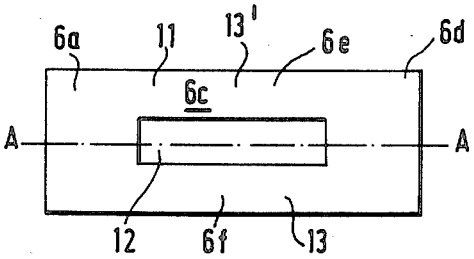

FIGS. 3, 3*a* and 3*b* show an anchor according to the invention, with FIG. 3 showing a front view of the anchor, FIG. 3*a* showing a side view of the anchor, and FIG. 3*b* showing a plan view of the anchor;

FIG. 4 shows the lower shank and foot part of a modified embodiment of an anchor of flat material in accordance with the invention;

FIG. 5 shows the anchor of FIG. 3 embedded in a precast concrete member;

FIGS. 6, 6*a* and 6*b* show another embodiment of a flat iron anchor according to the invention, in front, side and plan views, respectively.

DETAILED DESCRIPTION OF THE PREFERRED EMBODIMENTS

Figure 1:
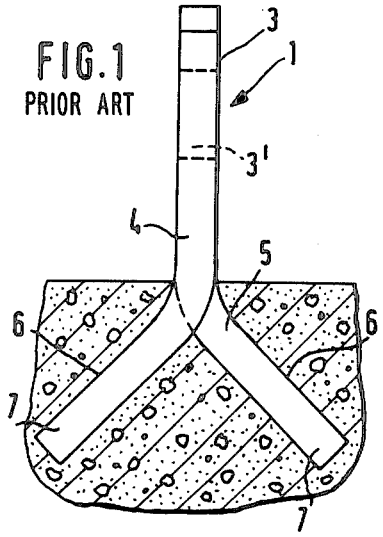
FIG. 1 PRIOR ART
FIG. 1 shows an expanding anchor known in the prior art.
Figure 2:
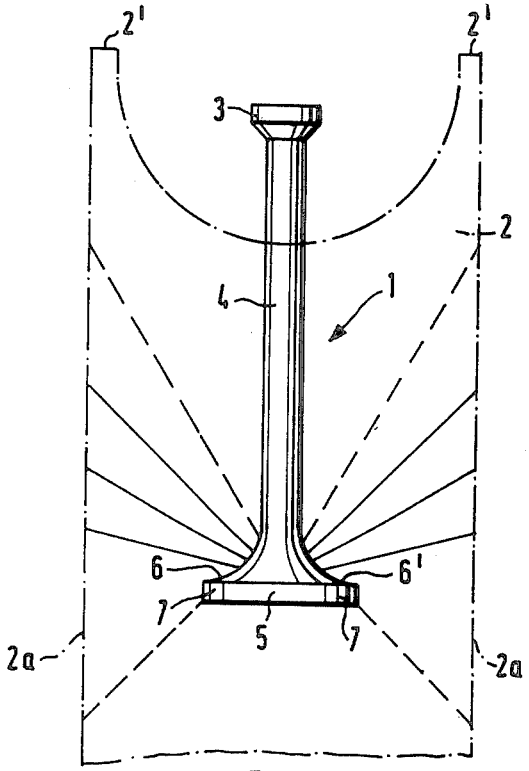
FIG. 2 PRIOR ART
FIG. 2 shows a round anchor also known in the prior art.

FIG. 1 shows a known flat iron anchor 1, consisting of solid material, having a head 3, receiving opening 3', for hooking in a coupling part of the hoisting tackle, and a shank 4 and foot 5. The foot 5 has expanding extensions 7 in the form of expanded legs which are bent apart after slitting of the foot. The foot with expanding extensions 7 is embedded in a precast concrete member 2. The surfaces 6 of the extensions 7 facing the head 3 of the anchor form the saddle surfaces, and the mass of concrete substantially above these saddle surfaces 6 is referred to as the breakout cone. The known round anchor design according to FIG. 2 is embedded in the relatively thin precast concrete member in such a way that the head 3 does not protrude beyond the upper edge 2' of the concrete member 2. Adjoining the embedded shank 4 is a roundly designed foot 5 which has expanding extensions 7 which project laterally beyond the cross-section of the shank and have saddle surfaces 6, 6'. Owing to the round design of the foot part 5 with expanding extensions 7, there are in each longitudinal cross-section identically designed expanding extensions with saddle surfaces, so that the saddle bearing load is correspondingly distributed on all sides. In the case of embedding in relatively thin precast concrete members, this has the disadvantage that the saddle bearing forces enter the parallel longitudinal surfaces 2*a* of the precast concrete member over a relatively short path. The solid and dashed lines shown in FIG. 2 illustrate the relatively large breakout cone occurring here, which also directly defines the side walls of the precast concrete member.

The exemplary embodiment of an anchor 1 according to the invention represented in FIGS. 3 to 3*b* shows an anchor of flat iron. The anchor 1 has, in a known way, an anchor head 3 with receiving opening 3' for a coupling piece of a hoisting device, a shank 4 and a foot 5 embedded in the precast concrete member 2. The anchor shank 4 has, at an adequate distance from its lower edge 10, a recess 8 lying transverse to its longitudinal axis in the form of a round hole which, together with the recess 3', is punched out of the flat material. Inserted in this recess 8 is a part T separate from the anchor 1 and consisting of flat iron, for example, a round bolt. The bolt has expanding extensions 7, 7' which project laterally beyond the cross-section of the shank 4 with the flatly designed saddle surfaces 6, 6' (or 6*a*, 6*b* in FIG. 4) pointing toward the anchor head 3. The surfaces 6, 6' (or 6*a*, 6*b* in FIG. 4) can be formed in a pressing operation after the insertion of the round bolt. The central section of this insert part T, namely the round bolt, is thus immovably mounted in the recess 8 on account of the wide, leaf-like design of the saddle surfaces 6, 6'. It is possible, in addition, to provide an absolutely rigid connection between the round bolt and the foot 5 of the shank by means of a deformation of the expanding extensions 7, 7' and 7*a*, 7*b* in such a way that an upset, bead-like shoulder or widening 15, 15' is formed on either side of and at least partially surrounding the recess 8.

Owing to this design, the expanding extensions 7, 7' projecting on either side of the anchor foot 5 can be provided with saddle surfaces 6, 6' which can be designed optimally in their geometrical shape and their attitude to the longitudinal axis A—A with regard to the saddle bearing forces which act in such a way that the position and magnitude of the saddle bearing forces and thus also the position and size of the breakout cone are predeterminable.

Advantageously, the surfaces 9, 9' (and 9*a*, 9*b* in FIG. 4) of the expanding extensions 7, 7' (FIGS. 3 to 3*b*) or 7*a*, 7*b* (FIG. 4) which are formed on the inserted round bolt and are opposite the saddle surfaces 6, 6' (FIGS. 3 to 3*b*) and 6*a*, 6*b* (FIG. 4), in other words facing the lower end of the foot 5 with its lower edge 10, may likewise be designed as flat surfaces.

As is apparent from the drawings, it is expedient to arrange the saddle surfaces symmetrical to the longitudinal center-axis A—A of the anchor to obtain precisely defined, uniform stresses on either side of the longitudinal axis A—A of the anchor 1.

The envisaged flat pressing of the protruding expanding extensions 7, 7' of the round bolt inserted into the bore 8 thus advantageously brings about the creation of precisely definable, even and adequately wide saddle surface 6, 6' and 6*a*, 6*b* which, depending on the design of the anchor, can be produced in such a size and shape that the saddle bearing forces are predeterminable and definable. In comparison with the known expanding anchor with bent-off expanding legs, and in comparison with the known two-hole anchor with inserted secondary irons of round cross-section, the anchor according to the invention has a widened, larger saddle surface and thus a considerably smaller contact pressure. The transverse forces which cannot be precisely calculated with respect to magnitude and position caused by the bending off of the expanding legs and by the roundings of the secondary iron, as shown in the prior art, are thus avoided. The rigid positive connection between anchor 1 and the inserted round bolt with transversely projecting saddle surfaces 7, 7' results in an anchorage which is, in comparison with a threaded secondary iron, absolutely stable and predeterminable with regard to the forces occurring.

The deformation according to the invention resulting in expanding extensions 7, 7' with flat saddle surfaces results furthermore in the advantage that the cross-section of the inserted bolt is unchanged in the region in which the greatest bearing load is effective, in other words directly alongside the periphery of the hole 8, so that there is at this point a maximum cross-section and thus an adequate strength of the crossbolt against the greatest transverse forces occurring at this point.

It is advantageous if the saddle surfaces 6, 6' and 6*a*, 6*b* are inclined to the longitudinal center-axis A—A at an obtuse angle $\alpha$ as then the saddle bearing forces, which act as normal forces perpendicular to the saddle surface, are distributed over a larger physical area, in other words over a larger mass of concrete, so that the concrete, which is less capable of withstanding tensile forces than compressive forces, is less stressed when lifting up the precast concrete member. At the same time, the expanding extensions 7, 7' and 7*a*, 7*b* may have, when seen in section through the longitudinal center-axis A—A, approximately the shape of a rectangular triangle or an approximated trapezoid shape, in a form that the cross-section increases in the direction of the recess 8, so that the expanding extensions in each case have their largest cross-section directly in this region.

In the case of the embodiment represented in FIG. 4, the saddle surfaces 6*a* and 6*b* are inclined to the longitudinal axis A—A at an angle $\alpha$ which is greater than the angle $\alpha$ of the exemplary embodiment of FIGS. 3 to 3*b*. In comparison with known expanding anchors, this means that the anchor according to the invention can be embedded in the precast concrete member with the same strength but at less embedded depth, allowing the anchor according to the invention, in particular the design according to FIG. 4, to be given an even shorter design length in comparison with known anchors, and thus a corresponding material saving. The design of the anchor according to the invention is particularly of advantage in the case of relatively narrow or thin precast concrete members as the saddle bearing forces occurring can, owing to the definable position and shape of the saddle surfaces 6, 6' and 6*a*, 6*b*, be directed in such a way that they lie substantially in the longitudinal center-plane of the anchor, given by the axis A—A, and thus of a narrow precast concrete member, so that the stressing of the side walls of a narrow precast concrete member, represented in FIG. 2, is largely avoided.

In the case of the exemplary embodiment represented in FIG. 4, the bottom surfaces 9*a*, 9*b* of the expanding extensions 7*a*, 7*b* are also inclined, but at a different angle $\alpha'$ which is designed smaller in comparison with the angle $\alpha$ between axis A—A and a generatrix of the saddle surfaces 6*a*, 6*b*. This produces a more favorable, approximately trapezoidal cross-sectional contour of the expanding extensions 7*a*, 7*b* with relatively steeply inclined saddle surfaces 6*a*, 6*b* with the advantage that the anchor as a whole can be kept even shorter with the same stressing.

In FIG. 5, an anchor of the embodiment according to FIG. 3 to 3*b* is embedded in a relatively thin precast concrete member 2, the head 3 of the anchor being inserted sunken into a corresponding recess of the precast concrete member in such a way that the borders 2' of the member 2 lie above the anchor head. In the foot part 5 of the anchor is the recess 8, in which the round bolt is inserted symmetrical to the anchor 1 in such a way that the expanding extensions 7, 7' protrude on either side of the anchor 1 with their saddle surfaces 6, 6' of equal length. It can be recognized that the saddle surfaces 6, 6' in the precast concrete member 2 have a precisely defined position and, owing to a large inclination of the saddle surfaces, as desired, the saddle bearing forces substantially lie in the region of the anchor and there is a correspondingly large breakout cone in the center region of the precast concrete member. Owing to the fact that the saddle surfaces 6, 6' and 6*a*, 6*b* run at an angle away from the recess 8, the expanding extensions 7, 7' and 7*a*, 7*b* lying transverse to the anchor 1 are less subjected to bending stresses than if the provided inclination of the saddle surfaces do not exist. A steeper inclination of the saddle surfaces 6*a*, 6*b*, corresponding to the representation of FIG. 4, has the advantage that the level of the saddle bearing load may be increased by the degree of the retraction of the saddle surfaces 6*a*, 6*b*, with the effect that, with the same design length of the anchor in comparison with the design according to FIGS. 3 to 3*b*, the effective embedded depth is functionally increased at the same length of the anchor.

FIGS. 6, 6*a* and 6*b* show another embodiment of the anchor according to the invention. Instead of a central hole 8 in the foot part 5 of the anchor, here the foot is provided at two opposite points with groove-like recesses 8', 8'', into which the expanding extensions 7*c*, 7*d* of a preferably rectangularly designed flat piece 11 are positively pressed. The expanding extensions 7*c*, 7*d* are directly formed from the flat iron piece 11. The flat iron piece 11 advantageously has a recess 12 corresponding to the cross-section of the anchor foot 5, the material of the flat iron piece 11 protruding on all sides.beyond the outside contour of the anchor foot forming the saddle surfaces 6*a*, 6*d*, 6*e* and 6*f*. To secure the flat iron piece 11 absolutely positively in the groove-shaped, preferably rectangular recesses 8', 8'' on the opposite borders of the foot 5, the two opposite central sections 13, 13' on the flat sides of the anchor 1 are deformed approximately V-shaped toward the lower edge 10' of the anchor, the apex 14 of the deformed center section 13, 13' lying in the longitudinal center-axis A—A of the anchor 1 to achieve the symmetrical position of the saddle bearing forces.

An anchor is thus produced which, similar to the design according to FIGS. 3 to 3*b*, has the advantage of a definable saddle surface which, just as in the case of the exemplary embodiment of FIGS. 3 to 3*b*, may be designed to be inclined downward. It is further of advantage here that the saddle surfaces 6*a*, 6*d*, 6*c* and 6*f* surround the cross-section of the flat anchor 1 on all sides so that the position and size of the saddle surfaces can be precisely predetermined depending on the stress conditions.

The V-shaped deformation in the direction toward the lower edge 10' of the anchor in the region of the two opposite central sections 13 and 13' also has the advantage that this design makes it possible to specify precisely the directional course of the load force.

In the case of the design according to FIGS. 6, *6a* and *6b*, just as in the case of the design of FIGS. 3 to *3b*, the saddle surfaces may be provided with an inclination in such a way that the saddle surfaces are directed in a preferred direction, for example, perpendicular to the longitudinal center-plane of the anchor. This makes it possible for the saddle bearing forces, in particular in the case of narrow precast concrete members, to run substantially parallel to the longitudinal sides of such a narrow member and for the forces directed transversely to the longitudinal sides, which forces can lead to lateral breaking out of the precast concrete member, to be largely avoided.

The production of the anchor according to the invention which, in preferred design, only consists of two flat iron parts, is simple and, owing to the small material requirement and the simple processing, inexpensive. It goes without saying that it is expedient to provide the recess 8 and 8' in each case with an adequate distance from the lower edge 10 and 10', respectively, in order that the tensile forces occurring here can be absorbed with sufficient certainty at the foot part of the anchor.

What is claimed is:

1. An anchor consisting of solid material and adapted to be embedded in a heavy load, for example, a precast concrete member, for permitting lifting of such member, comprising:

(a) an anchor having a longitudinal axis and being comprised of a head formed with a recess which extends clear of said precast member when said anchor is embedded and which is freely accessible for receiving lifting apparatus, and a solid anchor shank terminating at its lower end in a foot adapted to be embedded in such precast member, said shank being formed at a region spaced from its lower end with a transverse opening extending therethrough, and (b) an insert formed separately from said anchor and extending through said opening, and means for positively securing said insert in said opening, said insert having expanding extensions projecting laterally from said shank, said extensions having flat saddle surfaces on the top thereof for better absorption of load forces applied to said anchor through said recess, said extensions being greater in size in at least one dimension than the size of said transverse opening.

2. The anchor as claimed in claim 1, wherein said anchor head, shank and foot consist of flat iron; said insert includes a round bolt of the diameter of said recess in said shank and positioned therein, said round bolt being positively held in said transverse opening, and said expanding extensions being deformed at least on the upper surfaces thereof to form said flat saddle surfaces.

3. The anchor as claimed in claim 2, wherein said bolt is held in place in said recess by upset, bead-like shoulders on either side of the recess.

4. The anchor as claimed in claim 1, wherein the surfaces of the expanding extensions opposite said saddle surfaces are flat surfaces.

5. The anchor as claimed in claim 1, wherein said saddle surfaces are arranged symmetrical to the longitudinal center-axis of the anchor.

6. The anchor as claimed in claim 1, wherein said saddle surfaces are inclined at an obtuse angle to the longitudinal center-axis of said anchor.

7. The anchor as claimed in claim 1, wherein the expanding extensions have, when seen in section through the longitudinal center-axis of the anchor, approximately the shape of a rectangular triangle or a trapezoid.

8. The anchor as claimed in claim 6, wherein the bottom surfaces of said lateral extensions also form an obtuse angle with the center-axis of said anchor, the latter obtuse angle being smaller than the angle between the said center-axis and said saddle surfaces.

9. The anchor as claimed in claim 1, wherein said saddle surfaces diverge outwardly from said shank, and are approximately leaf-shaped when viewed from above.

10. An anchor consisting of solid material and adapted to be embedded in a heavy load, for example, a precast concrete member, for permitting lifting of such member, comprising:

(a) an anchor formed of flat iron and having a longitudinal axis, said anchor being comprised of a head formed with a recess which extends clear of said precast member when said anchor is embedded and which is freely accessible for receiving lifting apparatus, and a solid anchor shank terminating at its lower end in a foot adapted to be embedded in such precast member, said shank being formed at a region spaced from its lower end with a transverse opening extending therethrough, and (b) an insert formed separately from said anchor, said insert comprising a central bolt portion having a dimension and shape closely corresponding to the dimension and shape of said transverse opening, said bolt portion being firmly secured to said anchor foot at the edges of said transverse opening, said insert having expanding extensions projecting laterally from both sides of the central bolt portion and having flat saddle surfaces at least on the top surfaces thereof for better absorption of load forces applied to said anchor through said recess, said extensions being greater in size in at least one dimension than the size of said transverse opening.

11. The anchor as claimed in claim 10, wherein said bolt is round.

12. The anchor as claimed in claim 10, wherein said bolt is held in place in said recess by upset, beadlike shoulders on either side of said transverse opening.

13. The anchor as claimed in claim 10, wherein the bottom surfaces of the expanding extensions opposite said saddle surfaces are flat surfaces, and wherein said saddle and opposite surfaces are arranged symmetrical to the longitudinal center-axis of the anchor.

14. The anchor as claimed in claim 10, wherein said saddle surfaces are inclined at an obtuse angle to the longitudinal center-axis of said anchor.

15. The anchor as claimed in claim 14, wherein the bottom surfaces of said lateral extensions opposite said saddle surfaces also form an obtuse angle with the center-axis of said anchor, the latter obtuse angle being smaller than the angle between said center-axis and said saddle surfaces.

16. The anchor as claimed in claim 10, wherein said saddle surfaces diverge outwardly from said shank, and are approximately leaf-shaped when viewed from above.

* * * * *